United States Patent [19]

Kan et al.

[11] Patent Number: 4,808,077

[45] Date of Patent: Feb. 28, 1989

[54] PULSATIONLESS DUPLEX PLUNGER PUMP AND CONTROL METHOD THEREOF

[75] Inventors: Tsuneo Kan; Yozo Nakamura; Mieko Ishii, all of Shimoinayoshi, Japan

[73] Assignee: Hitachi, Ltd., Tokyo, Japan

[21] Appl. No.: 141,218

[22] Filed: Jan. 6, 1988

[30] Foreign Application Priority Data

Jan. 9, 1987 [JP] Japan ..... 62-2909

[51] Int. Cl.[4] ..... E04B 41/06; E04B 49/06; E04B 3/00

[52] U.S. Cl. ..... 417/2; 417/18; 417/45; 417/53; 417/265

[58] Field of Search ..... 417/2, 18, 22, 42, 43, 417/45, 53, 265

[56] References Cited

U.S. PATENT DOCUMENTS

| | | | |
|---|---|---|---|
| 3,847,507 | 11/1974 | Sakiyama et al. | 417/45 X |
| 4,225,290 | 9/1980 | Allington | 417/18 |
| 4,236,877 | 12/1980 | Curtis | 417/265 |
| 4,321,014 | 3/1982 | Eburn, Jr. et al. | 417/53 |
| 4,326,837 | 4/1982 | Gilson et al. | 417/45 X |
| 4,352,636 | 10/1982 | Patterson et al. | 417/265 X |
| 4,359,312 | 11/1982 | Funke et al. | 417/18 |
| 4,389,163 | 6/1983 | Magnussen, Jr. et al. | 417/265 X |
| 4,552,513 | 11/1985 | Miller et al. | 417/265 X |
| 4,556,367 | 12/1985 | Schmid | 417/18 |
| 4,566,858 | 1/1986 | Akiba | 417/45 X |
| 4,595,495 | 6/1986 | Yotam et al. | 417/18 X |
| 4,600,365 | 7/1986 | Riggenmann | 417/265 X |
| 4,681,513 | 7/1987 | Saito et al. | 417/2 |

FOREIGN PATENT DOCUMENTS

| | | | |
|---|---|---|---|
| 70976 | 5/1982 | Japan | 417/18 |
| 178569 | 8/1986 | Japan | 417/265 |
| 1534650 | 12/1978 | United Kingdom | 417/265 |

*Primary Examiner*—Paul F. Neils

*Attorney, Agent, or Firm*—Antonelli, Terry & Wands

[57] ABSTRACT

Velocity control of two plungers provided in a pulsationless duplex plunger pump is effected by detecting pressure of a resultant discharge from the two plungers and positions of the plungers, and correcting sequentially a velocity instruction of the each plunger, based on pressure corresponding to the detected position of the each plunger so that the sum of velocities of the two plungers will be constant.

10 Claims, 4 Drawing Sheets

PULSATIONLESS DUPLEX PLUNGER PUMP AND CONTROL METHOD THEREOF

BACKGROUND OF THE INVENTION

This invention relates to a pulsationless duplex plunger pump used for a liquid chromatography, medical inspection apparatus, etc. and, more particularly, to a pulsationless duplex plunger pump and a control method thereof in which velocity control is effected so as to minimize pressure pulsation.

As shown in Japanese Laid-Open No. 57-70975, in a conventional pulsationless flow pump which is a duplex plunger pump in which two plungers are reciprocated by one cam to obtain a resultant discharge through pumping operation of each of the two plungers, there is provided a mechanism which is connected to a driving motor wherein a revolution control circuit is connected to the cam and which corrects a detected output signal of the resultant discharge pressure by reversing the sign of the signal and adding the signal reversed in sign to a signal outputted from a revolution setting circuit after passing the detected output signal through a circuit for removing a component of direct current and through an amplifier. Further, the revolution control circuit comprises the revolution setting circuit, a main amplifier, and a tachogenerator which feeds back an output of the driving motor to the main amplifier.

However, in the above-mentioned prior art, (1) the detected output signal from a pressure detector is fed back through the amplifier, so that the control should be effected before a pressure pulsation takes place, while irrespectively, the revolution control is effected actually with a phase delay by a time constant which various devices or apparatus have, whereby a pressure ripple at the starting of pressure fluctuation can not be removed: (2) although only a pressure fluctuation part is detected because the detected signal of the pressure detector is passed through the circuit for removing a component of direct current, factually and accurately, a value obtained by multiplying a signal resultant from time-differentiation of the pressure fluctuation part by a constant should be a velocity correction value of the driving motor, so that the above-mentioned prior art could not effect sufficient velocity correction.

SUMMARY OF THE INVENTION

An object of the present invention is to provide a duplex plunger pump which is small in pressure pulsation, and a control method of the pump.

The invention to achieve the above object is characterized in that a velocity of each of plungers is controlled by detecting the pressure in a resultant discharge from two reciprocating pumps and a position of the each plunger and sequentially correcting instructions for velocity control of the plungers based on the pressure corresponding to each of the detected plunger positions.

DESCRIPTION OF THE EMBODIMENTS

An embodiment of the present invention will be described hereunder referring to the accompanying drawings.

Figure 2:
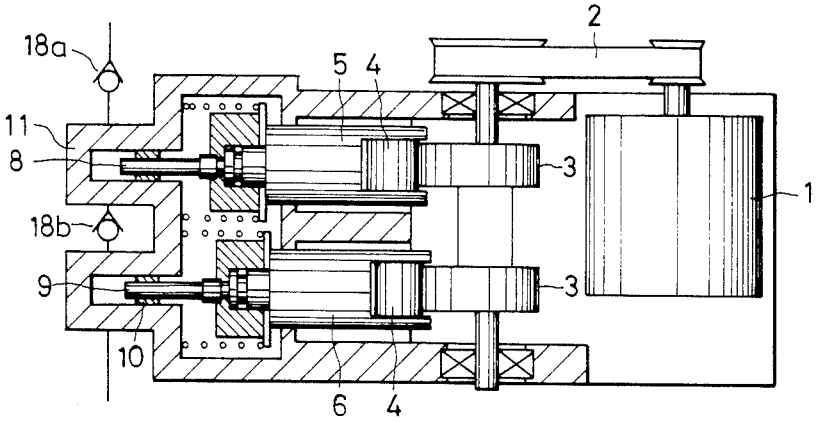
FIGS. 2 and 3 are sectional views of an example of a pulsationless duplex plunger pump to which the present invention is applied.

A pump shown here is a pulsationless duplex plunger pump in which one of two reciprocating pumps is provided with check valves at a suction side and a discharge side and an outlet of the check valve at the discharge side of the pump communicates with the other pump at the suction side. One example of the pump is shown in FIG. 2, and is constructed such that a pulse motor 1 drives a belt 2 which rotates cams 3 each mounted on the same shaft. Pistons 5, 6 each have a cam follower 4 contacting a respective cam 3 by a spring force for reciprocation of the pistons with rotation of the cams. The pistons, in turn, reciprocate first and second plungers 8, 9 in respective pump chambers formed in a cylinder head 11 to effect the pumping operation. The plungers 8, 9 are connected to end portions of pistons 5, 6 respectively and are made of wear-resistant and chemical resistant material such as ruby. Seals 10 are provided between the side walls of the cylinder chambers and the plungers 8, 9. The check valves **18*a*, 18*b* are provided in fluid passages as shown in FIG. 2. In the pump, the two cams 3 have cam faces formed so that a resultant velocity from velocities of the two plungers will be constant. The first plunger 8 moves at a velocity twice as fast as the second plunger 9** to discharge liquid while supplementing the second pump with liquid, and only the second pump delivers liquid through the operation of the check valves when the first pump is in a suction stroke.

Figure 3:
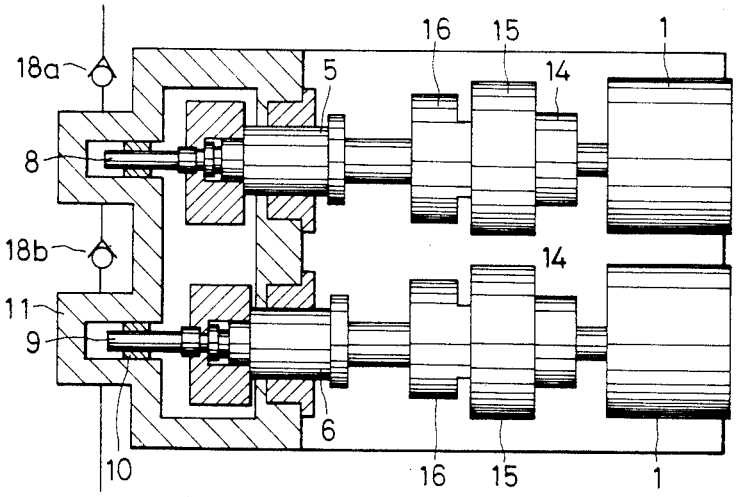

FIG. 3 shows another example of a pulsationless duplex plunger pump to which the present invention is applied.

Rotational movement of each of two individual pulse motors 1 is converted to a linear reciprocating movement of a piston 5, 6 through a drive and transmission system comprising an epicyclic reduction gear 14, a thrust bearing 15, and a ball nut screw 16, whereby first and second plungers 8, 9 connected to end portions of the pistons 5, 6 are driven by the respective individual pulse motors 1. A numeral 10 denotes a sealing, and numerals **18*a*, 18*b*** check valves.

Figure 1:
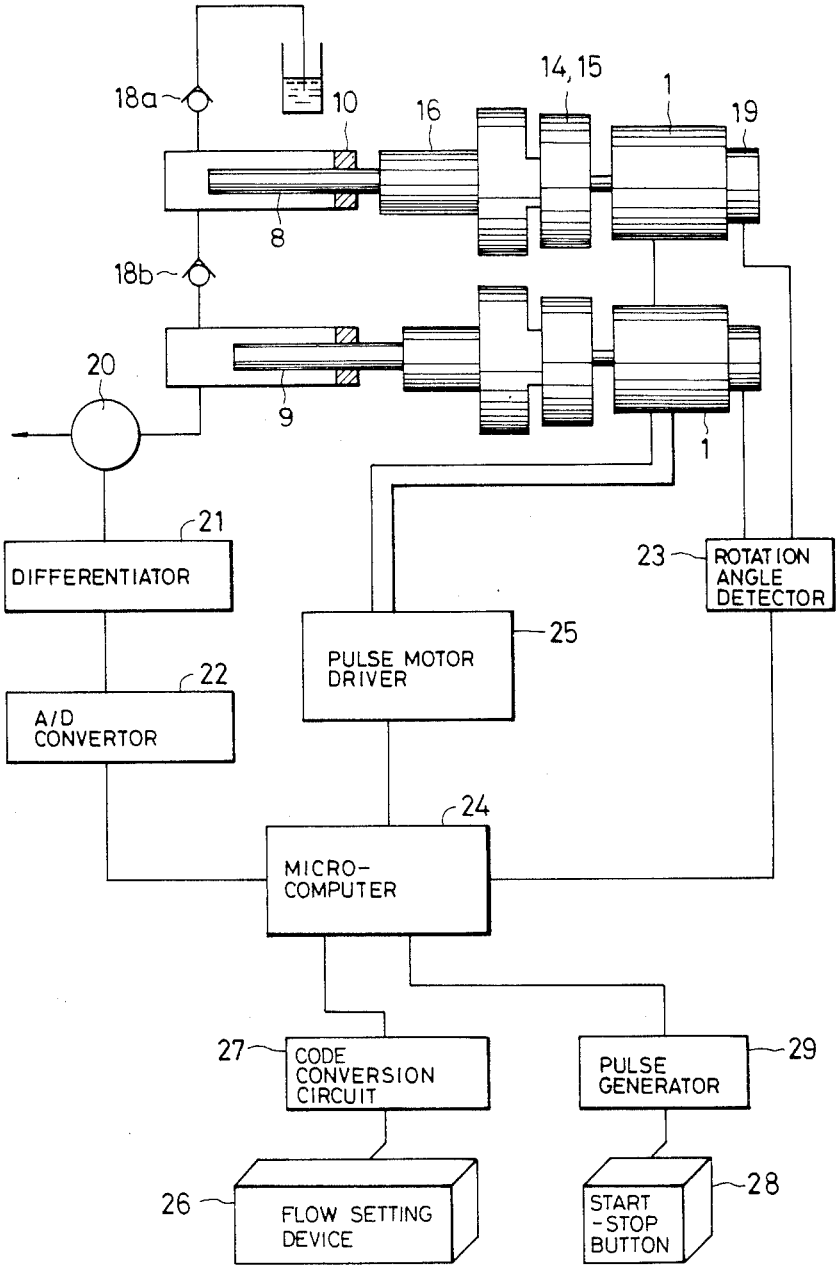
FIG. 1 is a view of a control circuit system according to an embodiment of the present invention.

An embodiment of the present invention using one of the above-mentioned pumps is described hereunder, referring to FIG. 1.

Figure 4:
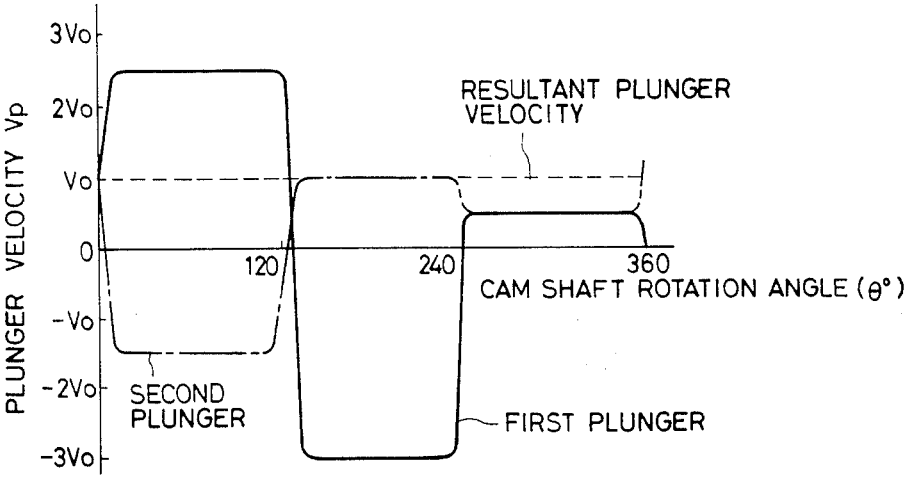
FIGS. 4 and 5 each are diaphragms showing a basic pattern of a plunger velocity according to the present invention.
Figure 6:
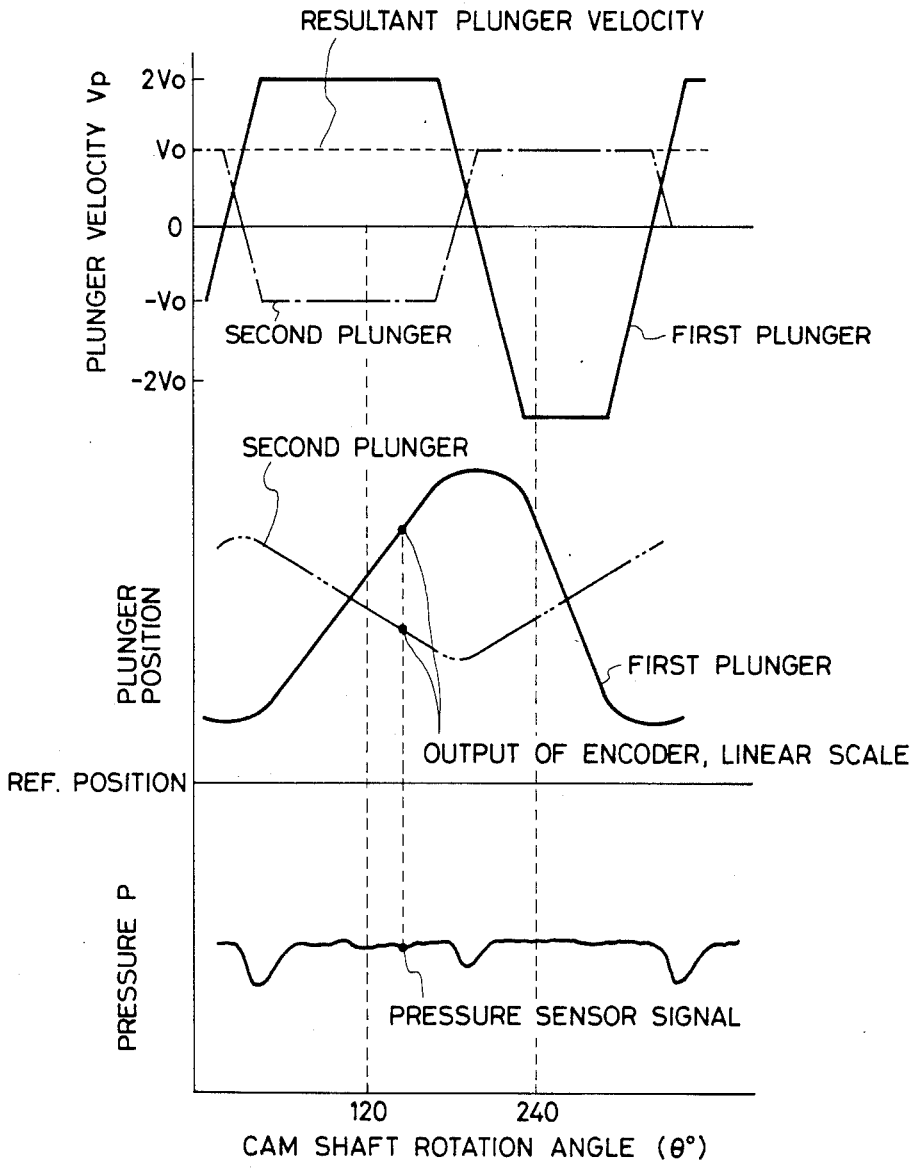
FIG. 6 is a graphical illustration showing the relationship of a plunger position, a plunger velocity $V_p$ and pressure P.

A preset flow signal which is set by a flow setting device 26 (or an outer flow controller) is converted into a binary code by a binary-coded decimal to binary code conversion circuit 27 to be inputted into a micro-computer 24. When in addition to this signal, a starting signal from a start-stop button 28 is inputted into the micro-computer 24 through a pulse generator 29, the micro-computer 24 calculates pulse-motor driving frequencies, etc., and a pulse train for generating a plunger velocity driving pattern as shown in FIG. 4, signals for determining a rotating direction and electric current control signals are inputted into a pulse-motor driver 25 from an output port of the micro-computer 24. In this embodiment, these signals are distributed at the pulse-motor driver 25 to drive individually two pulse motors 1. Upon rotation of the pulse motors 1, which are reversible electric motors, the rotation of each is decelerated by the respective epicyclic reduction gears 14, and converted into a linear reciprocating motion through the drive and transmission system comprising the thrust bearing 15, the ball nut screw 16, so that the plungers 8, 9 are reciprocated to pressurize a liquid to make it high in pressure and discharge the pressurized liquid. In this case, timing deviates so that pulsation takes place because of a difference in bulk modulus between used liquids when liquid of a low pressure is pressurized to be high in pressure, as well as a response delay in the check valves. Further, in time other than the switching period of time also, there is caused fluctuation in the plunger velocity because of errors in measurement in manufacturing parts constituting the driving apparatus, so that a small pulsation occurs. A pressure sensor 20 is provided to detect a line pressure and pressure pulsation. The detected signal is inputted into a differentiator 21 through an amplifier and a filter for removing noises, both of which are not illustrated. Output of the differentiator 21 is converted into a digital signal by a A/D converter 22 and inputted into the micro-computer 24. On the other hand, there are provided rotary encoders 19 mounted on the pulse motors 1 and a rotation angle detecting circuit 23 as means for detecting a position at which pressure pulsation takes place. By this means, a rotation angle of the pulse motors at which pressure pulsation takes place, or the number of pulses inputted into the pulse motor 1, from a reference point is detected. Further, as means for detecting a plunger position and a position where pressure pulsation takes place, a linear scale which detects a plunger position is preferable. Here, a resultant discharge pressure at a position of the plunger is obtained as follows. Namely, in the starting of the pump, both of the first and second pistons are driven and reach initial setting positions, respectively. Plunger positions are nearly equivalent to the piston positions. The piston position, which is described later, can be obtained by multiplying a time-integral value of driving frequency, having + or − sign according to a rotation direction of the motor, by a constant, and by adding the initial setting position thereto. The value thus obtained and the pressure signal (value) are stored in a memory means, whereby the pressure at a position of the plunger can be detected. Further, when the piston position is detected by the linear scale, an output of the linear scale is acknowledged as a plunger position. The relationship between the plunger position and the pressure, detected in this manner is shown in FIG. 6.

These signals are inputted into the micro-computer 24. The above-mentioned digitalized time-differential signal of pressure pulsation is converted into a correction signal of the plunger velocity, that is to say, a correction signal of the pulse motor driving frequency by multiplying the signal by a constant, and added to the pulse-motor driving frequency before one revolution at the detected position of pressure pulsation occurrence. In case of the pump shown in FIG. 2 being used, a resultant velocity from two plunger velocities is corrected taking an effect of the check valves into consideration. In case the pump shown in FIG. 3 is used, the correction of the plunger velocity is effected on one of the plungers which is in a discharge stroke.

Next, a plunger velocity control method will be explained.

Figure 5:
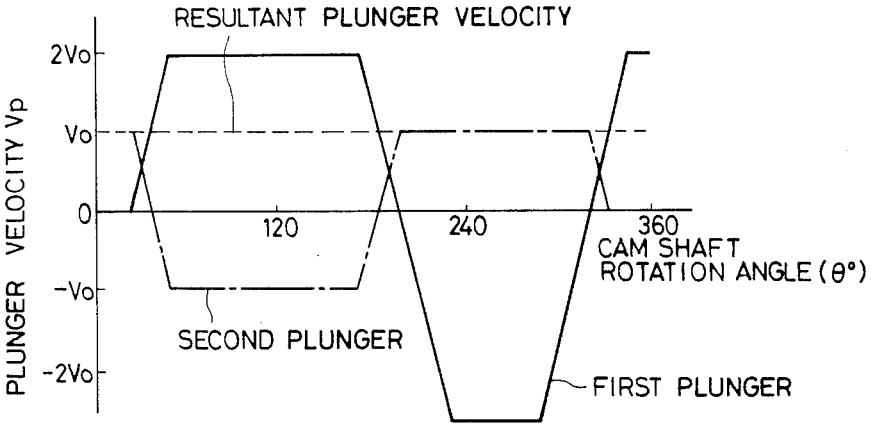

Velocity patterns of the two plungers are as shown in FIGS. 4, 5. The plungers are operated so that the sum of the two plunger velocities will be constant including an effect of the check valves, whereby on general principles, a pulsationless pump is made. However, in order to continuously discharge liquid of a high pressure, a switching must be effected in a moving direction and a velocity of the plunger. On this switching, pressure is lowered because of the response delay of the check valve and leakage of the liquid, and as a result, a pressure ripple is generated. Therefore, in this switching period of time, it is necessary to minimize pressure pulsation through control of the plunger velocity.

However, in case of the plunger velocity control, unless a magnitude of velocity correction corresponding to pressure pulsation, and a phase of the velocity correction to the pressure pulsation are proper, the pressure ripple is left. For example, in case of the pulse motor 1 being used as a motor, a plunger velocity $$\frac{d \times p}{dt}$$

is given as follows:

$$\frac{d \times p}{dt} = af$$

wherein a is a constant, and f is driving frequency of the pulse motor 1. In case of the second plunger 9, the following equation is established:

$$A \cdot \frac{d \times p}{dt} - \frac{V_2}{K} \frac{dP_2}{dt} = Q_2 + Q_1$$

wherein

A is a sectional area of the plunger, $Q_1$, an amount of liquid leakage, $Q_2$, flow rate, $V_2$, volume of a cylinder and a line passage, K, apparent bulk modulus of liquid, and $P_2$, pressure.

Therefore, a time differential value of the pressure pulsation corresponds to an amount of velocity correction of the plunger, that is to say, an amount of driving frequency correction.

Accordingly, in the present invention, when the two plungers are driven by the two cams mounted on a shaft common thereto, an amount of correction of a resultant velocity of the two plungers is set so as to be proportional to a time differential value of the pressure pulsation. Where pressure starts to decrease, it is necessary to increase the velocity of the plunger. On the contrary, where the pressure starts to rise, it is necessary to lower the plunger velocity. Therefore, in case of a resultant velocity of the plungers being set, a sign of time differential value of the pressure pulsation is made reverse. Further, signals of the detected pressure pulsation are passed through the amplifier and the differentiator, so that a delay by an amount of a time constant which the device or apparatus have is caused. Therefore, as for the plunger velocity, at least an amount of a phase differential value is corrected by the operation of the micro-computer. Further, in case two plungers are driven individually using two motors, a leakage takes place because of a response delay of the check valves when a discharge stroke is shifted to a suction stroke, so that the above-mentioned amount of piston velocity correction is added to one of the plungers which is in discharge stroke. In this manner, feed back control is effected so that the phase is set proper by shifting the phase while detecting pressure pulsation of the discharged liquid.

By controlling as mentioned above, velocity correction of the plunger corresponding to pressure pulsation can be carried out, and effected at a suitable time to the pressure pulsation.

Next, a method of setting a proper phase of the velocity correction of the plunger in order to make a small pressure pulsation will be described hereunder.

As mentioned above, when the pressure is detected, the pressure pulsation obtained through the amplifier, the filter and the differentiator is delayed by time constants at such devices or apparatus, compared with the pressure pulsation appearing in the pressure sensor mounted right near to the delivery port of the pump, namely, the pressure pulsation which is delayed in phase compared to one in the pressure sensor is taken in, so that the timing of velocity correction which is obtained through the detection of rotation angle of the pulse motor 1 is not necessarily proper. Therefore, for first correction, a velocity correction time is shifted by a delayed time which can be prospected, and after that, an amount of shift of the phase is determined judging whether or not there is a change in a position of occurrence of the pressure pulsation and whether or not there is a change in the sign of the positional signal. When the variation is within a preset range, locking is effected. Concretely, in case the position of occurrence of the pressure pulsation does not change and in case the sign also does not change, the preset timing remains the same. If the sign changed, the control is effected so as to be delayed by one half of the before value because the phase was excessively advanced. By controlling thus, plunger velocity correction of a proper timing and a proper value can be effected.

Another control method according to the present invention is explained hereunder.

In case of the pulse motor being used as a motor, for example, a plunger velocity $$\frac{d \times p}{dt}$$

is given as follows:

$$\frac{d \times p}{dt} = af$$

wherein a is a constant and f, a driving frequency of the pulse motor. In case of attention being paid on the first and second plungers 8, 9, the following equations are established:

$$A\frac{d \times p_1}{dt} - \frac{V_1}{K}\frac{dP_1}{dt} = Q_{12} - Q_{10}$$

$$A\frac{d \times p_2}{dt} - \frac{V_2}{K}\frac{dP_2}{dt} = Q - Q_{12}$$

wherein

A is a sectional area of each of the plungers;

Q, a flow rate to column;

$Q_{12}$, a flow rate from the first plunger 8 to the second plunger 9 or a leakage amount, $Q_{10}$, a flow rate from a container to the first plunger 8 or a leakage amount;

$V_2$, a volume of the second cylinder and a pipe passage;

$V_1$, a volume of the first cylinder;

K, an apparent bulk modulus of the liquid, and $P_1$, $P_2$, pressure in the first and second cylinder, respectively.

In a liquid chromatography apparatus, a column is used for separating components, so that, in general, a flow rate Q is proportional to the pressure. Therefore, taking $\alpha$ as a proportional constant, the following equations are given by adding the above two equations one to another;

$$\frac{dP_2}{dt} + \frac{K \cdot \alpha}{V_2} P_2 = \frac{KA}{V_2}\left(\frac{d \times p_1}{dt} + \frac{d \times p_2}{dt}\right) + \epsilon(t)$$

$$\epsilon(t) = -\frac{V_1}{V_2}\frac{dP_1}{dt} + \frac{K}{V_2} Q_{10}$$

When the second piston 6 is in a discharge stroke, the following is considered to be established;

$$\epsilon(t) = \frac{K}{V_2} Q_{12}.$$

Assuming that $\epsilon(t)$ is a term of disturbance from the outside, pressure pulsation and a pressure level in the resultant discharge liquid are determined according to a change in the disturbance term and the velocity. If the disturbance term is included in a term of velocity fluctuation, by determining a base line of pressure to be Pm through observation of the pressure $P_2$ and obtaining a time differential value $$\frac{dP_2}{dt},$$

a velocity correction value can be obtained by the following equation:

$$\Delta V = \left\{ -\frac{dP_2}{dt} + A_0(Pm - P_2) \right\} / B_0.$$

Namely, a time differential value of pressure pulsation and a differential between the base line pressure and a measured pressure correspond to an amount of plunger velocity correction, that is, an amount of correction of the driving frequency.

Accordingly, in the present invention, in case the two plungers are driven by the two cams mounted on the same shaft, an amount of correction of a resultant velocity of the two plungers is set so as to be proportional to the sum of the time differential value (reversed sign) of pressure pulsation and the differential between the base line pressure and the measured pressure. Further, signals of the detected pressure pulsation pass through the apparatus or devices, so that a time delay by a time constant of the apparatus or the device takes place. Therefore, as for the plunger velocity, at least an amount of this phase differential is corrected by the operation of the micro-computer.

Further, in case of the two plungers being independently driven by the two motors, a leakage takes place due to a response delay of the check valve where a discharge stroke is shifted to a suction stroke, so that at such a switching time, the above-mentioned piston velocity correction amount is added to one of the two pistons which is in a discharge stroke. In a time other than the switching time, the above-mentioned piston velocity correction amount is added to the second plunger so that the pressure in the second cylinder can be directly controlled. In this manner, the plunger velocity can be corrected corresponding to the pressure pulsation, and at a proper time to the pressure pulsation. Further, the control encloses a pressure clause, so that the control can be effected even in case there is a pressure difference between the suction stroke and the discharge stroke of the second plunger because of a liquid leakage in the check valves.

Further, constants $A_0$, $B_0$ have different values according to the kinds of liquid, however, the constants can be determined by detecting the time differential value of pressure, pressure and the sum of plunger velocities.

As mentioned above, according to the invention, the plunger velocity correction of a magnitude suitable to remove fluctuation of the pressure pulsation can be effected and the plunger velocity correction can be effected with a suitable phase differential, so that the pressure pulsation can be minimized.

What is claimed is:

1. A pulsationless duplex plunger pump in which check valves are provided at a suction side and at a discharge side of one of two reciprocating pumps incorporated therein, said two reciprocating pumps being arranged in series and driven by electric drive motor means, and an outlet of said check valve at the discharge side communicates with the other incorporated pump, which comprises:

means for detecting pressure in a resultant liquid discharged from said two reciprocating pumps;

means for detecting a position of a plunger of each of said reciprocating pumps;

memory means for storing an instruction of a plunger velocity at every position of said each plunger;

means for correcting the instruction of the plunger velocity from said memory means, based on the pressure corresponding to the detected position of said each plunger so that the sum of velocities of said two plungers will be constant; and means for controlling a velocity of each of said plungers according to corrected velocity instruction through a control of said electric drive motor means, wherein said velocity instruction correction is effected by adding a value proportional to a value obtained through reversing a sign of a time differential value of the pressure in said resultant discharged liquid.

2. A pulsationless duplex plunger pump in which check valves are provided at a suction side and at a discharge side of one of two reciprocating pumps incorporated therein, said two reciprocating pumps being arranged in series and driven by electric drive motor means, and an outlet of said check valve at the discharge side communicates with the other incorporated pump, which comprises:

means for detecting pressure in a resultant liquid discharged from said two reciprocating pumps;

means for detecting a position of a plunger of each of said reciprocating pumps;

memory means for storing an instruction of a plunger velocity at every position of said each plunger;

means for correcting the instruction of the plunger velocity from said memory means, based on the pressure corresponding to the detected position of said each plunger so that the sum of velocities of said two plungers will be constant; and means for controlling a velocity of each of said plungers according to corrected velocity instruction through a control of said electric drive motor means, wherein said velocity instruction correction is effected by adding a value proportional to the sum of a value obtained by reversing a sign of a time differential value of the pressure in said resultant discharged liquid and a value proportional to a value obtained by subtraction of the detected pressure from a base line pressure.

3. A pulsationless duplex plunger pump in which check valves are provided at suction and discharge sides of one of two reciprocating pumps incorporated therein in series and driven by electric drive motor means, and an outlet of said check valve at the discharge side communicates with the other incorporated pump, which comprises:

means for detecting pressure in a resultant liquid discharged from said two pumps;

means for detecting a plunger position of each of said reciprocating pumps;

means for differentiating the detected pressure with respect to time to obtain a differential value of the pressure in the resultant discharged liquid;

means for obtaining a velocity instruction so that the sum of velocities of said two plungers becomes constant, based on the obtained pressure in the resultant discharged liquid and the detected plunger position;

means for correcting the velocity instruction by adding thereto a value proportional to a value obtained by reversing a sign of said differential value of the pressure; and means for inputting the corrected velocity instruction into a plunger driver and controlling the velocity of said each plunger.

4. A pulsationless duplex plunger pump comprising:

a pair of reciprocating pumps fluidly connected with each other in series;

check valves provided at suction and discharge sides of one of said reciprocating pumps;

a pair of cams mounted on a shaft for reciprocating plungers of said reciprocating pumps at different speeds, respectively;

means for driving said shaft having said cams mounted thereon to rotate;

means for detecting pressure in a resultant liquid discharged from said two pumps;

means for detecting a plunger position of one of said plungers;

means for generating an electric instruction for plunger driving velocity, according to which said driving means is driven to reciprocate said plungers, based on a set value of flow rate required of said duplex plunger pump;

means for differentiating the detected pressure with respect to time to obtain a differential value of the pressure in the resultant liquid discharged from said reciprocating pumps;

means for correcting said electric instruction, by adding a value proportional to a value obtained through reversing a sign of the differential value of the pressure in the resultant discharged liquid at each plunger position; and means for controlling said driving means according to the corrected electric instruction for plunger velocity.

5. A method of controlling a pulsationless duplex plunger pump having two reciprocating pumps in series and check valves provided at suction and discharge sides of one of said reciprocating pumps, said method comprising the steps of:

detecting a position of a plunger of one of said reciprocating pumps;

detecting pressure in a resultant liquid discharged from said two reciprocating pumps, the pressure to be detected corresponding to a position of said plunger;

calculating a valocity instruction based on a predetermined flow rate required of said duplex plunger pump and the plunger position and storing the velocity instruction;

differentating the detected pressure with respect to time to obtain a time-differential value of the pressure in the resultant discharged liquid;

correcting the stored velocity instruction based on the time-differential value of the pressure and the detected plunger position; and controlling the reciprocating pumps by using the corrected velocity instruction so that a flow rate of the resultant liquid discharged from the reciprocating pumps is constant.

6. A method as defined in claim 5, wherein first correction of the velocity instruction is effected at a time earlier than a timing of the velocity instruction correction obtained through calculation based on the detected pressure and the detected plunger position, and after that the correction timing is shifted by a predetermined time with respect to the prior correction timing through judging whether or not there is a change in a position of occurrence of the pressure pulsation and whether or not there is a change in the sign of the positional signal.

7. A method as defined in claim 5, wherein said velocity instruction is corrected by adding a value proportional to a value obtained through reversing a sign of a time differential value of said discharged liquid pressure.

8. A method as defined in claim 5, wherein said velocity instruction correction is effected by adding a value proportional to the sum of a value obtained by reversing a sign of a time differential value of said discharged liquid pressure and a value proportional to a value obtained through subtraction of said detected pressure from a base line pressure.

9. A method of controlling a pulsationless duplex plunger pump in which check valves are provided at suction and discharge sides of one of two reciprocating pumps incorporated therein in series and driven by electric drive motor means, comprising the steps of:

detecting pressure in a resultant liquid discharged from said two pumps, said pressure to be detected corresponding to a position of each of said pumps;

correcting a stored velocity instruction of said each plunger from the detected pressure so as to make the sum of velocities of said two plungers constant; and controlling a velocity of said each plunger based on a corrected velocity instruction, wherein said velocity instruction is corrected by adding a value proportional to a value obtained through reversing a sign of a time differential value of said discharged liquid pressure.

10. A method of controlling a pulsationless duplex plunger pump in which check valves are provided at suction and discharge sides of one of two reciprocating pumps incorporated therein in series and driven by electric drive motor means, comprising the steps of:

detecting pressure in a resultant liquid discharged from said two pumps, said pressure to be detected corresponding to a position of each of said pumps;

correcting a stored velocity instruction of said each plunger from the detected pressure so as to make the sum of velocities of said two plungers constant; and controlling a velocity of said each plunger based on a corrected velocity instruction, wherein said velocity instruction correction is effected by adding a value proportional to the sum of a value obtained by reversing a sign of a time differential value of said discharged liquid pressure and a value proportional to a value obtained through subtraction of said detected pressure from a base line pressure.

* * * * *